US010497383B2

(12) United States Patent
Xiao et al.

(10) Patent No.: US 10,497,383 B2
(45) Date of Patent: Dec. 3, 2019

(54) VOICE QUALITY EVALUATION METHOD, APPARATUS, AND DEVICE

(71) Applicant: Huawei Technologies Co., Ltd., Shenzhen (CN)

(72) Inventors: Wei Xiao, Shenzhen (CN); Suhua Li, Xi'an (CN); Fuzheng Yang, Shenzhen (CN)

(73) Assignee: HUAWEI TECHNOLOGIES CO., LTD., Shenzhen (CN)

( * ) Notice: Subject to any disclaimer, the term of this patent is extended or adjusted under 35 U.S.C. 154(b) by 0 days.

(21) Appl. No.: 15/829,098

(22) Filed: Dec. 1, 2017

(65) Prior Publication Data

US 2018/0082704 A1 Mar. 22, 2018

Related U.S. Application Data

(63) Continuation of application No. PCT/CN2016/079528, filed on Apr. 18, 2016.

(30) Foreign Application Priority Data

Nov. 30, 2015 (CN) ..... 2015 1 0859464

(51) Int. Cl.
*G10L 25/60* (2013.01)
*G10L 25/69* (2013.01)
(Continued)

(52) U.S. Cl.
CPC ..... *G10L 25/60* (2013.01); *G10L 25/18* (2013.01); *G10L 25/21* (2013.01); *G10L 25/30* (2013.01); *G10L 25/69* (2013.01)

(58) Field of Classification Search
CPC ..... G10L 25/60; G10L 25/69
See application file for complete search history.

(56) References Cited

U.S. PATENT DOCUMENTS 6,741,569 B1 * 5/2004 Clark ..... G10L 25/69 370/252
7,856,355 B2 12/2010 Kim
(Continued)

FOREIGN PATENT DOCUMENTS

CN 102103855 A 6/2011
CN 102137194 A 7/2011
(Continued)

OTHER PUBLICATIONS

Kim, "Anique: An auditory model for single-ended speech quality estimation." IEEE Transactions on Speech and Audio Processing 13.5 (2005).*
(Continued)

*Primary Examiner* — Samuel G Neway
(74) *Attorney, Agent, or Firm* — Conley Rose, P.C.

(57) ABSTRACT

A voice quality evaluation method includes obtaining a time envelope of a voice signal. The method includes performing time-to-frequency conversion on the time envelope to obtain an envelope spectrum. The method includes performing feature extraction on the envelope spectrum to obtain a feature parameter. The method includes performing voice quality evaluation in voice communications according to the feature parameter to obtain a first voice quality parameter of the voice signal. The method includes calculating a second voice quality parameter of the voice signal by using a network parameter evaluation model. The method includes performing a comprehensive analysis according to the first voice quality parameter and the second voice quality parameter to obtain a quality evaluation parameter of the voice signal that is input in the band.

17 Claims, 4 Drawing Sheets

(51) Int. Cl.

| | |
|---|---|
| ***G10L 25/18*** | (2013.01) |
| ***G10L 25/21*** | (2013.01) |
| ***G10L 25/30*** | (2013.01) |

(56) References Cited

U.S. PATENT DOCUMENTS

| | | | | |
|---|---|---|---|---|
| 2002/0064186 | A1* | 5/2002 | Aoyagi | G10L 25/69 370/521 |
| 2002/0191798 | A1* | 12/2002 | Juric | G10L 25/69 381/56 |
| 2007/0011006 | A1* | 1/2007 | Kim | G10L 25/69 704/233 |
| 2008/0151769 | A1* | 6/2008 | El-Hennawey | G10L 25/69 370/252 |
| 2009/0234652 | A1 | 9/2009 | Kato et al. | |
| 2012/0116759 | A1* | 5/2012 | Folkesson | G10L 25/69 704/226 |
| 2013/0028448 | A1 | 1/2013 | Choi et al. | |
| 2015/0179187 | A1* | 6/2015 | Xiao | G10L 25/60 704/270 |
| 2015/0213798 | A1* | 7/2015 | Xiao | G10L 25/69 704/246 |
| 2018/0082704 | A1* | 3/2018 | Xiao | G10L 25/60 |

FOREIGN PATENT DOCUMENTS

| | | | |
|---|---|---|---|
| CN | 102148033 | A | 8/2011 |
| CN | 1022324229 | A | 1/2012 |
| CN | 103730131 | A | 4/2014 |
| CN | 104269180 | A | 1/2015 |
| CN | 104485114 | A | 4/2015 |

OTHER PUBLICATIONS

Randari et al., "An ensemble learning model for single-ended speech quality assessment using multiple-level signal decomposition method." 2014 4th International Conference on Computer and Knowledge Engineering (ICCKE). IEEE, 2014.*

ITU-T P.563, Series P: Telephone Transmission Quality, Telephone Installations, Local Line Networks, Objective measuring apparatus, Single-ended method for objective speech quality assessment in narrow-band telephony applications, May 2004, 66 pages.

Machine Translation and Abstract of Chinese Publication No. CN102137194, Jul. 27, 2011, 24 pages.

Machine Translation and Abstract of Chinese Publication No. CN102103855, Jun. 22, 2011, 12 pages.

Machine Translation and Abstract of Chinese Publication No. CN102148033, Aug. 10, 2011, 13 pages.

Machine Translation and Abstract of Chinese Publication No. CN102324229, Jan. 18, 2012, 27 pages.

Foreign Communication From a Counterpart Application, PCT Application No. PCT/CN2016/079528, English Translation of International Search Report dated Aug. 24, 2016, 2 pages.

Falk, T., et al., "A Non-Intrusive Quality Measure of Dereverberated Speech," XP055495020, IEEE Transactions on Audio, Speech and Language Processing, Sep. 14, 2008, 4 pages.

Goudarzi, M., et al., "Modelling Speech Quality for NB and WB SILK Codec for VoIP Applications," XP032012376, 5th International Conference on Next Generation Mobile Applications and Services, Sep. 14, 2011, pp. 42-47.

Kitawaki, N., et al., "Speech-Quality Assessment Methods for Speech-Coding Systems," XP002042571, IEEE Communications Magazine, vol. 22, No. 10, Oct. 1, 1984, pp. 26-33.

Foreign Communication From a Counterpart Application, European Application No. 16869530.2, Extended European Search Report dated Aug. 6, 2018, 7 pages.

Machine Translation and Abstract of Chinese Publication No. CN104269180, Jan. 7, 2015, 13 pages.

Machine Translation and Abstract of Chinese Publication No. CN104485114, Apr. 1, 2015, 13 pages.

* cited by examiner

VOICE QUALITY EVALUATION METHOD, APPARATUS, AND DEVICE

CROSS-REFERENCE TO RELATED APPLICATIONS

This application is a continuation of International Application No. PCT/CN2016/079528, filed on Apr. 18, 2016, which claims priority to Chinese Patent Application No. 201510859464.2, filed with the Chinese Patent Office on Nov. 30, 2015 and entitled "Voice Quality Evaluation Method, Apparatus, And Device". The disclosures of the aforementioned applications are hereby incorporated herein by reference in their entireties.

TECHNICAL FIELD

The present disclosure relates to the field of audio technologies, and in particular, to a voice quality evaluation method, apparatus, and device.

BACKGROUND

In recent years, with rapid development of communications networks, network voice communication has become an important aspect of social communication. In a current big data environment, monitoring performance and quality of voice communications networks is particularly important.

Currently, there is no simple and effective low-complexity algorithm for a signal-domain-based objective model of voice quality evaluation in voice communications. Researches in the industry mainly focus on numerous factors affecting voice quality in voice communications, and relatively few researches can provide a low-complexity signal-domain-based evaluation model.

In an existing signal-domain-based objective technology of voice quality evaluation, a process of voice signal perception by a human auditory system is simulated by using a mathematical signal model. In the technology, auditory perception is simulated by using a cochlea filter, then time-to-frequency conversion is performed on N sub-signal envelopes that are output by using a cochlea filter bank, and spectrums of the N signal envelopes are processed by means of an analysis of a human articulatory system, to obtain a quality score of a voice signal.

In the prior art: (1) Use of a cochlea filter to simulate a human auditory system to perceive a voice signal is relatively crude. On one hand, this is because a mechanism for voice signal perception in a human body is complex, includes not only an auditory system but also cerebral cortex processing, human neural processing, and priori knowledge in life, and is a comprehensive cognition and determining process combining multiple subjective and objective aspects. On the other hand, this is because responses of cochleae of different individuals to a voice signal frequency are not completely the same, and responses of cochleae of people to a voice signal frequency that are measured in different time periods are not completely the same. (2) The cochlea filter divides an entire spectrum band of a voice signal into multiple key frequency bands for processing. Therefore, corresponding convolution operation processing needs to be performed on the voice signal in each key frequency band. This process requires complex computation and relatively high resource consumption, and is deficient in monitoring a huge and complex communications network.

Therefore, an existing signal-domain-based solution of voice quality evaluation has high computational complexity, requires high resource consumption, and does not have a sufficient capability to monitor a huge and complex voice communications network.

SUMMARY

Embodiments of the present disclosure provide a voice quality evaluation method, apparatus, and device, so as to alleviate, by using a low-complexity signal-domain-based evaluation model, a problem of high complexity and severe resource consumption in an existing signal-domain-based evaluation solution.

According to a first aspect, an embodiment of the present disclosure provides a voice quality evaluation method, including obtaining a time envelope of a voice signal, performing time-to-frequency conversion on the time envelope to obtain an envelope spectrum, performing feature extraction on the envelope spectrum to obtain a feature parameter, calculating a first voice quality parameter of the voice signal according to the feature parameter, calculating a second voice quality parameter of the voice signal by using a network parameter evaluation model, and performing an analysis according to the first voice quality parameter and the second voice quality parameter to obtain a quality evaluation parameter of the voice signal.

In the voice quality evaluation method provided in this embodiment of the present disclosure, auditory perception is not simulated based on a high-complexity cochlea filter. The time envelope of the input voice signal is directly obtained; time-to-frequency conversion is performed on the time envelope to obtain the envelope spectrum; feature extraction is performed on the envelope spectrum to obtain an articulation feature parameter; later, the first voice quality parameter of the voice signal that is input in currently analyzed data is obtained according to the articulation feature parameter; the second voice quality parameter is obtained by means of calculation according to the network parameter evaluation model; and a comprehensive analysis is performed according to the first voice quality parameter and the second voice quality parameter to obtain the quality evaluation parameter of the voice signal that is input in the band. Therefore, in this embodiment of the present disclosure, on the basis of covering main impact factors affecting voice quality in voice communications, computational complexity can be reduced, and occupied resources can be reduced.

With reference to the first aspect, in a first possible implementation of the first aspect, the performing feature extraction on the envelope spectrum to obtain a feature parameter includes determining an articulation power frequency band and a non-articulation power frequency band in the envelope spectrum, where the feature parameter is a ratio of a power in the articulation power frequency band to a power in the non-articulation power frequency band. The articulation power frequency band is a frequency band whose frequency bin is 2 hertz (Hz) to 30 Hz in the envelope spectrum, and the non-articulation power frequency band is a frequency band whose frequency bin is greater than 30 Hz in the envelope spectrum.

In this way, the articulation power frequency band and the non-articulation power frequency band are extracted, based on an articulation analysis of an articulation system, from the envelope spectrum, and the ratio of the power in the articulation power frequency band to the power in the non-articulation power frequency band is used as an important parametric value for measuring voice perception quality. An articulation power band and a non-articulation power band are defined according to the principle of a human articulation system. This complies with a human articulation psychological auditory theory.

With reference to the first possible implementation of the first aspect, in a second possible implementation of the first aspect, the calculating a first voice quality parameter of the voice signal according to the feature parameter includes calculating the first voice quality parameter of the voice signal by using the following function:

$$y=ax^b,$$

where x is the ratio of the power in the articulation power frequency band to the power in the non-articulation power frequency band, and a and b are preset model parameters and are both rational numbers. A group of available model parameters include a=18, and b=0.72.

With reference to the first possible implementation of the first aspect, in a third possible implementation of the first aspect, the calculating a first voice quality parameter of the voice signal according to the feature parameter includes calculating the first voice quality parameter of the voice signal by using the following function:

$$y=a\ \ln(x)+b,$$

where x is the ratio of the power in the articulation power frequency band to the power in the non-articulation power frequency band, and a and b are preset model parameters and are both rational numbers. A group of available model parameters includes a=4.9828, and b=15.098.

With reference to the first aspect, in a fourth possible implementation of the first aspect, the performing time-to-frequency conversion on the time envelope to obtain an envelope spectrum includes performing discrete wavelet transform on the time envelope to obtain N+1 sub-band signals, where the N+1 sub-band signals are the envelope spectrum, and N is a positive integer, and the performing feature extraction on the envelope spectrum to obtain a feature parameter includes respectively calculating average energy corresponding to the N+1 sub-band signals to obtain N+1 average energy values, where the N+1 average energy values are the feature parameter. In this way, more feature parameters can be obtained. This facilitates accuracy improvement of an analysis on voice signal quality.

With reference to the fourth possible implementation of the first aspect, in a fifth possible implementation of the first aspect, the calculating a first voice quality parameter of the voice signal according to the feature parameter includes using the N+1 average energy values as an input layer variable of a neural network, obtaining $N_H$ hidden layer variables by using a first mapping function, mapping the $N_H$ hidden layer variables by using a second mapping function to obtain an output variable, and obtaining the first voice quality parameter of the voice signal according to the output variable, where $N_H$ is less than N+1.

With reference to any one of the first aspect or the first possible implementation of the first aspect to the fifth possible implementation of the first aspect, in a sixth possible implementation of the first aspect, the network parameter evaluation model includes at least one evaluation model of a bit rate evaluation model or a packet loss rate evaluation model; and the calculating a second voice quality parameter of the voice signal by using a network parameter evaluation model includes calculating, by using the bit rate evaluation model, a voice quality parameter that is of the voice signal and that is measured by bit rate; and/or calculating, by using the packet loss rate evaluation model, a voice quality parameter that is of the voice signal and that is measured by packet loss rate.

With reference to the sixth possible implementation of the first aspect, in a seventh possible implementation of the first aspect, the calculating, by using the bit rate evaluation model, a voice quality parameter that is of the voice signal and that is measured by bit rate includes calculating, by using the following formula, the voice quality parameter that is of the voice signal and that is measured by bit rate:

$$Q_1 = c - \frac{c}{1+\left(\frac{B}{d}\right)^e},$$

where $Q_1$ is the voice quality parameter measured by bit rate, B is an encoding bit rate of the voice signal, and c, d, and e are preset model parameters and are all rational numbers.

With reference to the sixth possible implementation of the first aspect, in an eighth possible implementation of the first aspect, the calculating, by using the packet loss rate evaluation model, a voice quality parameter that is of the voice signal and that is measured by packet loss rate includes calculating, by using the following formula, the voice quality parameter that is of the voice signal and that is measured by packet loss rate:

$$Q_2=fe^{-g\cdot P},$$

where $Q_2$ is the voice quality parameter measured by packet loss rate, P is an encoding bit rate of the voice signal, and e, f, and g are preset model parameters and are all rational numbers.

With reference to any one of the first aspect or the first possible implementation of the first aspect to the eighth possible implementation of the first aspect, in a ninth possible implementation of the first aspect, the performing an analysis according to the first voice quality parameter and the second voice quality parameter to obtain a quality evaluation parameter of the voice signal includes adding the first voice quality parameter to the second voice quality parameter to obtain the quality evaluation parameter of the voice signal.

According to a second aspect, an embodiment of the present disclosure further provides a voice quality evaluation apparatus, including an obtaining module, configured to obtain a time envelope of a voice signal, a time-to-frequency conversion module, configured to perform time-to-frequency conversion on the time envelope to obtain an envelope spectrum, a feature extraction module, configured to perform feature extraction on the envelope spectrum to obtain a feature parameter, a first calculation module, configured to calculate a first voice quality parameter of the voice signal according to the feature parameter, a second calculation module, configured to calculate a second voice quality parameter of the voice signal by using a network parameter evaluation model, and a quality evaluation module, configured to perform an analysis according to the first voice quality parameter and the second voice quality parameter to obtain a quality evaluation parameter of the voice signal.

With reference to the second aspect, in a first possible implementation of the second aspect, the feature extraction module is specifically configured to determine an articulation power frequency band and a non-articulation power frequency band in the envelope spectrum, where the feature parameter is a ratio of a power in the articulation power frequency band to a power in the non-articulation power frequency band. The articulation power frequency band is a frequency band whose frequency bin is 2 Hz to 30 Hz in the envelope spectrum, and the non-articulation power frequency band is a frequency band whose frequency bin is greater than 30 Hz in the envelope spectrum.

With reference to the first possible implementation of the second aspect, in a second possible implementation of the second aspect, the first calculation module is specifically configured to calculate the first voice quality parameter of the voice signal by using the following function:

$$y=ax^b,$$

where x is the ratio of the power in the articulation power frequency band to the power in the non-articulation power frequency band, and a and b are preset model parameters and are both rational numbers.

With reference to the first possible implementation of the second aspect, in a third possible implementation of the second aspect, the first calculation module is specifically configured to calculate the first voice quality parameter of the voice signal by using the following function:

$$y=a\ \ln(x)+b,$$

where x is the ratio of the power in the articulation power frequency band to the power in the non-articulation power frequency band, and a and b are preset model parameters and are both rational numbers.

With reference to the second aspect, in a fourth possible implementation of the second aspect, the time-to-frequency conversion module is specifically configured to perform discrete wavelet transform on the time envelope to obtain N+1 sub-band signals, where the N+1 sub-band signals are the envelope spectrum. The feature extraction module is specifically configured to respective calculate average energy corresponding to the N+1 sub-band signals to obtain N+1 average energy values, where the N+1 average energy values are the feature parameter, and N is a positive integer.

With reference to the fourth possible implementation of the second aspect, in a fifth possible implementation of the second aspect, the first calculation module is specifically configured to: use the N+1 average energy values as an input layer variable of a neural network, obtain $N_H$ hidden layer variables by using a first mapping function, map the $N_H$ hidden layer variables by using a second mapping function to obtain an output variable, and obtain the first voice quality parameter of the voice signal according to the output variable, where $N_H$ is less than N+1.

With reference to any one of the second aspect or the first possible implementation of the second aspect to the fifth possible implementation of the second aspect, in a sixth possible implementation of the second aspect, the network parameter evaluation model includes at least one of a bit rate evaluation model or a packet loss rate evaluation model; and the second calculation module is specifically configured to: calculate, by using the bit rate evaluation model, a voice quality parameter that is of the voice signal and that is measured by bit rate; and/or calculate, by using the packet loss rate evaluation model, a voice quality parameter that is of the voice signal and that is measured by packet loss rate.

With reference to the sixth possible implementation of the second aspect, in a seventh possible implementation of the second aspect, the second calculation module is specifically configured to: calculate, by using the following formula, the voice quality parameter that is of the voice signal and that is measured by bit rate:

$$Q_1 = c - \frac{c}{1+\left(\frac{B}{d}\right)^e},$$

where $Q_1$ is the voice quality parameter measured by bit rate, B is an encoding bit rate of the voice signal, and c, d, and e are preset model parameters and are all rational numbers.

With reference to the sixth possible implementation of the second aspect, in an eighth possible implementation of the second aspect, the second calculation module is specifically configured to: calculate, by using the following formula, the voice quality parameter that is of the voice signal and that is measured by packet loss rate:

$$Q_2=fe^{-g\cdot P},$$

where $Q_2$ is the voice quality parameter measured by packet loss rate, P is an encoding bit rate of the voice signal, and e, f, and g are preset model parameters and are all rational numbers.

With reference to any one of the second aspect or the first possible implementation of the second aspect to the eighth possible implementation of the second aspect, in a ninth possible implementation of the second aspect, the quality evaluation module is specifically configured to: add the first voice quality parameter to the second voice quality parameter to obtain the quality evaluation parameter of the voice signal.

According to a third aspect, an embodiment of the present disclosure further provides a voice quality evaluation device, including a memory and a processor. The memory is configured to store an application program. The processor is configured to execute the application program, so as to perform all or some steps of the voice quality evaluation method in the first aspect.

According to a fourth aspect, the present disclosure further provides a computer storage medium. The medium stores a program. The program performs some or all steps of the voice quality evaluation method in the first aspect.

It can be learned from the foregoing technical solutions that the solutions in the embodiments of the present disclosure have the following beneficial effects:

In the voice quality evaluation method provided in the embodiments of the present disclosure, the time envelope of the input voice signal is directly obtained; time-to-frequency conversion is performed on the time envelope to obtain the envelope spectrum; feature extraction is performed on the envelope spectrum to obtain an articulation feature parameter; later, the first voice quality parameter of the voice signal that is input in the band is obtained according to the articulation feature parameter; the second voice quality parameter is obtained by means of calculation according to the network parameter evaluation model; and a comprehensive analysis is performed according to the first voice quality parameter and the second voice quality parameter to obtain the quality evaluation parameter of the voice signal that is input in the band.

In the solution, on condition that auditory perception is not simulated based on a high-complexity cochlea filter, main impact factors affecting voice quality in voice communications are extracted, so as to implement quality evaluation on the voice signal, thereby reducing computational complexity and avoiding resource consumption.

DESCRIPTION OF EMBODIMENTS

The following clearly describes the technical solutions in the embodiments of the present disclosure with reference to the accompanying drawings in the embodiments of the present disclosure. Apparently, the described embodiments are merely some but not all of the embodiments of the present disclosure. All other embodiments obtained by persons of ordinary skill in the art based on the embodiments of the present disclosure without creative efforts shall fall within the protection scope of the present disclosure.

A voice quality evaluation method in the embodiments of the present disclosure may be applied to various application scenarios. Typical application scenarios include voice quality detection on a terminal side and voice quality detection on a network side.

Applying to the typical application scenario of voice quality detection on a terminal side is embedding an apparatus using the technical solution in the embodiments of the present disclosure into a mobile phone, or evaluating voice quality during a call by using a mobile phone using the technical solution in the embodiments of the present disclosure. Specifically, for a mobile phone of one party during a call, after receiving a bitstream, the mobile phone may reconstruct a voice file by decoding the bitstream. The voice file is used as a voice signal that is input in the embodiments of the present disclosure, so that quality of received voice can be obtained. The voice quality basically reflects quality of voice actually heard by a user. Therefore, the technical solution in the embodiments of the present disclosure is used in a mobile phone, so that quality of actual voice heard by a user can be effectively evaluated.

In addition, usually, voice data needs to be transmitted to a receiver by using several nodes in a network. Due to impact of some factors, voice quality may be lowered after network transmission. Therefore, it is very meaningful to detect voice quality at each node on a network side. However, in many existing methods, quality at a transmission layer is more reflected and is not in a one-to-one correspondence with true feelings of a person. Therefore, application of the technical solution described in the embodiments of the present disclosure to each network node may be considered, and quality prediction is synchronously performed, so as to find a quality bottleneck. For example, for any network result, a bitstream is analyzed, and a particular decoder is selected to perform local decoding on the bitstream, so as to reconstruct a voice file. The voice file is used as an input voice signal in the embodiments of the present disclosure, so that voice quality at a node can be obtained. Voice quality at different nodes is compared, so that a node needing to be improved can be located. Therefore, such an application can play an important role of assisting network optimization of an operator.

Figure 1:
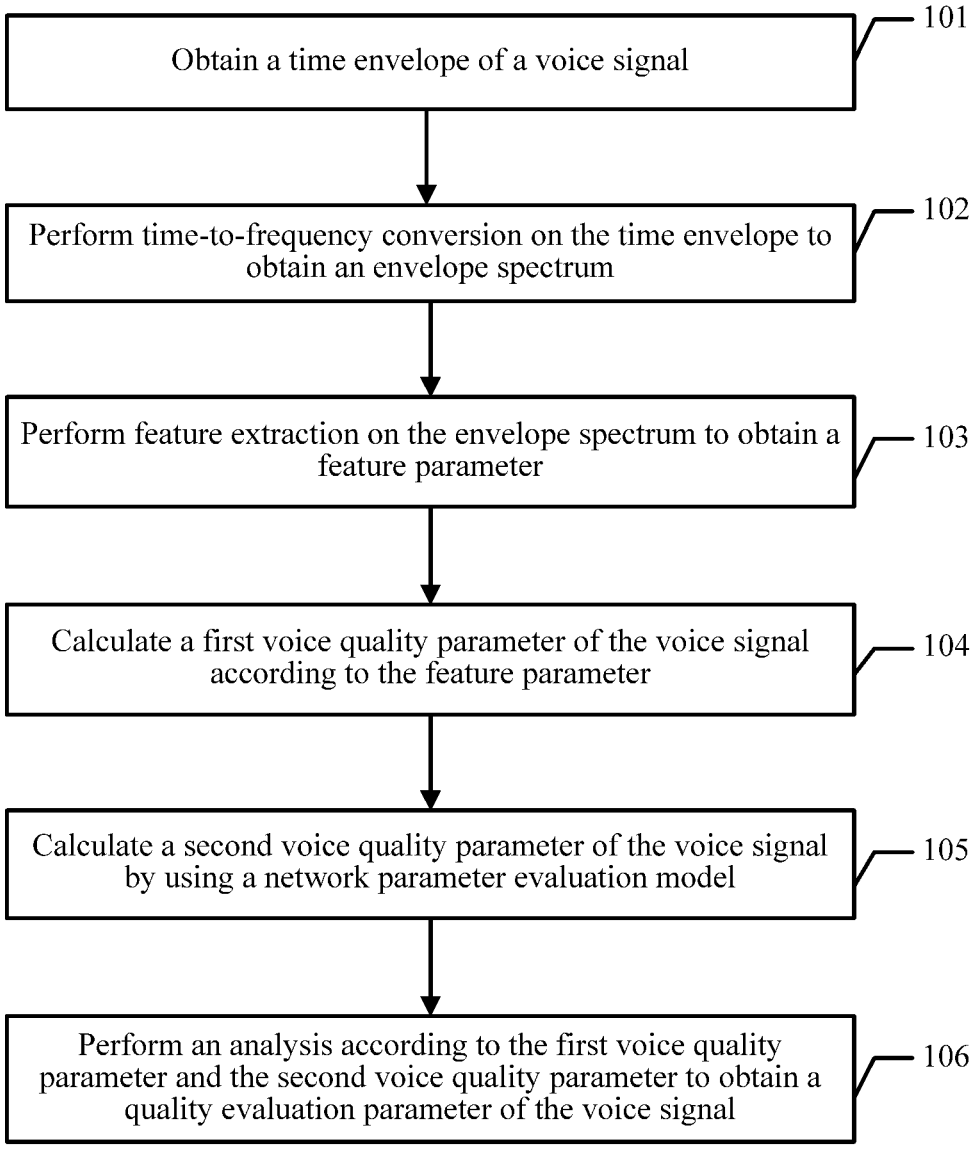
FIG. 1 is a flowchart of a voice quality evaluation method according to an embodiment of the present disclosure.

FIG. 1 is a flowchart of a voice quality evaluation method according to an embodiment of the present disclosure. The method may be performed by a voice quality evaluation apparatus. As shown in FIG. 1, the method includes the following steps.

101: Obtain a time envelope of a voice signal.

Usually, voice quality evaluation is performed in real time. Each time a voice signal in a time segment is received, a voice quality evaluation procedure is performed. The voice signal herein may be measured in frames. That is, when a voice signal frame is received, a voice quality evaluation procedure is performed. The voice signal frame herein represents a voice signal of particular duration. The duration of the voice signal may be set by a user according to a requirement.

Related researches indicate that a voice signal envelope carries important information related to voice cognition and understanding. Therefore, each time receiving a voice signal in a time segment, the voice quality evaluation apparatus obtains a time envelope of the voice signal in the time segment.

Optionally, in the present disclosure, a corresponding parsing signal is constructed by using a Hilbert transform theory. By using an original voice signal and a Hilbert transform signal of the signal, a time envelope of the voice signal is obtained. For example, a parsing signal $z(n)=x(n)+j\hat{x}(n)$ may be constructed, where n indicates a signal number, $x(n)$ is an original signal, $\hat{x}(n)$ is Hilbert transform of the original signal $x(n)$, and j is an imaginary number part. Therefore, an envelope of the original signal $x(n)$ may be represented as: squaring the original signal and a harmonic signal of the original signal to obtain squared values, summing the squared values to obtain a sum value, and obtaining a square root of the sum value:

$$r(n)=\sqrt{x(n)^2+\hat{x}(n)^2}.$$

102: Perform time-to-frequency conversion on the time envelope to obtain an envelope spectrum.

Lots of prior experiments and related phonetic and physiological researches show that an important factor representing voice quality in a signal domain is distribution of content of an envelope spectrum of a voice signal in a spectrum domain. Therefore, after a time envelope of a voice signal in a time segment is obtained, time-to-frequency conversion is performed on the time envelope to obtain an envelope spectrum.

Optionally, during actual application, time-to-frequency conversion may be performed on the time envelope in multiple manners. Signal processing manners such as short-time Fourier transform and wavelet transform may be used.

Short-time Fourier transform essentially is adding a time window function (a time span is usually relatively short) before Fourier transform is performed. When a time resolution requirement of a singular signal is definite, a satisfying effect can be achieved by selecting short-time Fourier transform of a short length. However, a time or a frequency resolution of short-time Fourier transform depends on a window length, and once being determined, the window length cannot be changed.

For wavelet transform, a time-frequency resolution may be determined by setting a scale. Each scale corresponds to a compromise of an undetermined time-frequency resolution. Therefore, a proper time-frequency resolution can be adaptively obtained by changing the scale. That is, an appropriate compromise between a time resolution and a frequency resolution can be obtained according to an actual status, so as to perform other subsequent processing.

103: Perform feature extraction on the envelope spectrum to obtain a feature parameter.

After time-to-frequency conversion is performed on the time envelope to obtain the envelope spectrum, the envelope spectrum of the voice signal is analyzed by means of an articulation analysis, to obtain the feature parameter in the envelope spectrum.

104: Calculate a first voice quality parameter of the voice signal according to the feature parameter.

After an articulation feature parameter is obtained, the first voice quality parameter of the voice signal is calculated according to the articulation feature parameter. A voice signal quality parameter may be represented by a mean opinion score (MOS). A value of the MOS ranges from 1 score to 5 scores.

105: Calculate a second voice quality parameter of the voice signal by using a network parameter evaluation model.

In a voice quality evaluation process, considering that a signal interrupt, silence, and the like in a voice communications network may also affect voice perception quality of a user, impact, on voice quality, of signal domain factors that are network environments such as an interrupt and silence and that affect voice signal quality in the voice communications network is considered in the present disclosure, and a parameter evaluation model at a network transmission layer is introduced to perform voice quality evaluation on the voice signal.

Quality evaluation is performed on the input voice signal by using the network parameter evaluation model to obtain voice quality measured by a network parameter. The voice quality measured according to a network parameter herein is the second voice quality parameter.

Specifically, a network parameter affecting the voice signal quality in the voice communications network includes, but is not limited to, parameters such as an encoder, an encoding bit rate, a packet loss rate, and a network delay. For different network parameters, different network parameter evaluation model may be used to obtain a voice quality parameter of the voice signal. Descriptions are provided below by using examples based on an encoding bit rate evaluation model and a packet loss rate evaluation model.

Optionally, a voice quality parameter that is of the voice signal and that is measured by bit rate is calculated by using the following formula:

$$Q_1 = c - \frac{c}{1+\left(\frac{B}{d}\right)^e}.$$

$Q_1$ is the voice quality parameter measured by bit rate and may be represented by a MOS. A value of the MOS ranges from 1 to 5. B is an encoding bit rate of the voice signal, and c, d, and e are preset model parameters. Such parameters may be obtained by means of sample training of a voice subjective database. c, d, and e are all rational numbers, and values of c and d are not 0. A group of feasible empirical values are as follows:

| | Parameter | | |
|---|---|---|---|
| | c | d | e |
| Value | 1.377 | 2.659 | 1.386 |

Optionally, a voice quality parameter that is of the voice signal and that is measured by packet loss rate is calculated by using the following formula:

$$Q_2 = fe^{-g \cdot P}.$$

$Q_2$ is the voice quality parameter measured by packet loss rate and may be represented by a MOS. A value of the MOS ranges from 1 score to 5 scores. P is an encoding bit rate of the voice signal, and e, f, and g are preset model parameters. Such parameters may be obtained by means of sample training of a voice subjective database. e, f, and g are all rational numbers, and a value of f is not 0. A group of feasible empirical values are as follows:

| | Parameter | | |
|---|---|---|---|
| | e | f | g |
| Value | 1.386 | 1.42 | 0.1256 |

It should be noted that the second voice quality parameter may be multiple voice quality parameters obtained by using multiple network parameter evaluation models. For example, the second voice quality parameter may be the voice quality parameter measured by bit rate and the voice quality parameter measured by packet loss rate.

106: Perform an analysis according to the first voice quality parameter and the second voice quality parameter to obtain a quality evaluation parameter of the voice signal.

A joint analysis is performed on the first voice quality parameter obtained according to the feature parameter in step 104 and the second voice quality parameter calculated according to the network parameter evaluation model in step 105, so as to obtain the voice quality evaluation parameter of the voice signal.

Optionally, a feasible manner is adding the first voice quality parameter to the second voice quality parameter to obtain the quality evaluation parameter of the voice signal.

For example, if the second voice quality parameter calculated according to the network parameter evaluation model in step 105 includes the voice quality parameter $Q_1$ measured by bit rate and the voice quality parameter $Q_2$ measured by packet loss rate, and the first voice quality parameter obtained according to the feature parameter in step 104 is $Q_3$, a final quality evaluation parameter of the voice signal is:

$$Q = Q_1 + Q_2 + Q_3.$$

Usually, the final quality evaluation parameter is obtained by using an ITU-T P.800 testing method, and an output MOS value ranges from 1 score to 5 scores.

In the voice quality evaluation method provided in this embodiment of the present disclosure, auditory perception is not simulated based on a high-complexity cochlea filter. The time envelope of the input voice signal is directly obtained; time-to-frequency conversion is performed on the time envelope to obtain the envelope spectrum; feature extraction is performed on the envelope spectrum to obtain an articulation feature parameter; later, the first voice quality parameter of the voice signal that is input in the band is obtained according to the articulation feature parameter; the second voice quality parameter is obtained by means of calculation according to the network parameter evaluation model; and a comprehensive analysis is performed according to the first voice quality parameter and the second voice quality parameter to obtain the quality evaluation parameter of the voice signal that is input in the band. Therefore, computational complexity is reduced, few resources are occupied, and main impact factors affecting voice quality in voice communications are covered.

During actual application, feature extraction is performed on the envelope spectrum in multiple manners. One manner is determining a ratio of a power in an articulation power band to a power in a non-articulation power band, and obtaining the first voice quality parameter by using the ratio. Detailed descriptions are provided below with reference to FIG. 2.

201: Obtain a time envelope of a voice signal.

A time envelope of an input signal is obtained. A specific time envelope obtaining manner is the same as that in step 101 in the embodiment shown in FIG. 1.

202: Apply a Hamming window to the time envelope to perform discrete Fourier transform, to obtain an envelope spectrum.

A corresponding Hamming window is applied to the time envelope to perform discrete Fourier transform, so as to perform time-to-frequency conversion, to obtain the envelope spectrum of the time envelope. The envelope spectrum is A(f)=FFT(γ(n).Ham min gWindow). In this embodiment of the present disclosure, to improve efficiency of Fourier transform, a fast algorithm FFT of Fourier transform is used.

203: Determine a ratio of a power in an articulation power frequency band to a power in a non-articulation power frequency band in the envelope spectrum.

The envelope spectrum of the voice signal is analyzed by means of an articulation analysis, and a spectrum band associated with a human articulation system and a spectrum band not associated with the human articulation system in the envelope spectrum are extracted as an articulation feature parameter. The spectrum band associated with the human articulation system is defined as an articulation power band, and the spectrum band not associated with the human articulation system is defined as a non-articulation power band.

Preferably, in this embodiment of the present disclosure, the articulation power band and the non-articulation power band are defined according to the principle of the human articulation system. A frequency of vocal cord vibration of a human is approximately below 30 Hz. Distortion that can be perceived by a human auditory system comes from a spectrum band above 30 Hz. Therefore, a frequency band of 2 Hz to 30 Hz in a voice envelope spectrum is associated as the articulation power frequency band; a spectrum band above 30 Hz is associated as the non-articulation power frequency band.

Power in the articulation power band reflects a signal component related to natural human voice, and power in the non-articulation power band reflects perceptual distortion generated in a rate exceeding a rate of a human articulation system. Therefore, a ratio $$ANR = \frac{P_A}{P_{NA}}$$

of a power $P_A$ in A the articulation power band to a power $P_{N/A}$ in the non-articulation power band is determined. The ratio $$ANR = \frac{P_A}{P_{NA}}$$

of the power in the articulation power band to the power in the non-articulation power band is used as an important parametric value for measuring voice perception quality, and voice quality evaluation is provided by using the ratio.

Specifically, a power in a frequency band of 2 Hz to 30 Hz is the power $P_A$ in the articulation power band; a power in a spectrum band above 30 Hz is the power $P_{N/A}$ in the non-articulation power band.

204: Determine a first voice quality parameter of the voice signal according to the ratio of the power in the articulation power frequency band to the power in the non-articulation power frequency band.

After the articulation feature parameter, that is, the ratio ANR of the power in the articulation power band to the power in the non-articulation power band is obtained, a communications voice quality parameter may be represented as a function of ANR $$y=f(ANR).$$

y represents the communications voice quality parameter determined by a ratio of the power in the articulation power frequency band to the power in the non-articulation power frequency band. ANR is the ratio of the articulation power to the non-articulation power.

In a possible implementation, $y=ax^b$. x is the ratio ANR of the power in the articulation power frequency band to the power in the non-articulation power frequency band, and a and b are model parameters obtained by means of sample data training. Values of a and b depend on distribution of trained data. a and b are both rational numbers, and a value of a cannot be 0. A group of available model parameters includes a=18, and b=0.72. When a MOS is used to represent the voice quality parameter, a value of y ranges from 1 to 5.

In a possible implementation, y=a ln(x)+b. x is the ratio ANR of the power in the articulation power frequency band to the power in the non-articulation power frequency band, and a and b are model parameters obtained by means of sample data training. Values of a and b depend on distribution of trained data. a and b are both rational numbers, and a value of a cannot be 0. A group of available model parameters includes a=4.9828, and b=15.098. When a MOS is used to represent the voice quality parameter, a value of y ranges from 1 to 5.

It should be noted that an articulation power spectrum should not be limited to a human articulation frequency range or the foregoing frequency range from 2 Hz to 30 Hz. Similarly, a non-articulation power spectrum should not be limited to a frequency range greater than a frequency range related to articulation power. A range of the non-articulation power spectrum may overlap with or be adjacent to a range of the articulation power spectrum, or may not overlap with or be adjacent to the range of the articulation power spectrum. If the range of the non-articulation power spectrum is overlapped with the range of the articulation power spectrum, an overlapping part may be considered as the articulation power frequency band, or may be considered as the non-articulation power frequency band.

In this embodiment of the present disclosure, time-to-frequency conversion is performed on the time envelope of the voice signal to obtain the envelope spectrum; the articulation power frequency band and the non-articulation power frequency band are extracted from the envelope spectrum; the ratio of the power in the articulation power frequency band to the power in the non-articulation power frequency band is used as the articulation feature parameter; the ratio is used as an important parametric value for measuring voice perception quality; and the first voice quality parameter is calculated by using the ratio. The solution has low computational complexity and little resource consumption, and may be applied, with features of simplicity and effectiveness, to evaluation and monitoring on communication quality of a voice communications network.

Another manner of performing feature extraction on the envelope spectrum is performing wavelet transform on the envelope, and calculating average energy of each sub-band signal. Detailed descriptions are provided below.

30 Hz may be used as a section point between an articulation power band and a non-articulation power band of a human articulation system according to a psychological auditory theory, and feature extraction is separately performed on two parts: a low band and a high band. However, the foregoing embodiment does not provide any concrete method to analyze the frequency band above 30 Hz and its impact to the voice quality. Therefore, an embodiment of the present disclosure provides another method for extracting more articulation feature parameters. Specifically, wavelet discrete transform is performed on a voice signal to obtain N+1 sub-band signals, average energy of the N+1 sub-band signals is calculated, and a voice quality parameter is calculated by using the average energy of the N+1 sub-band signals. Detailed descriptions are provided below.

Figure 3:
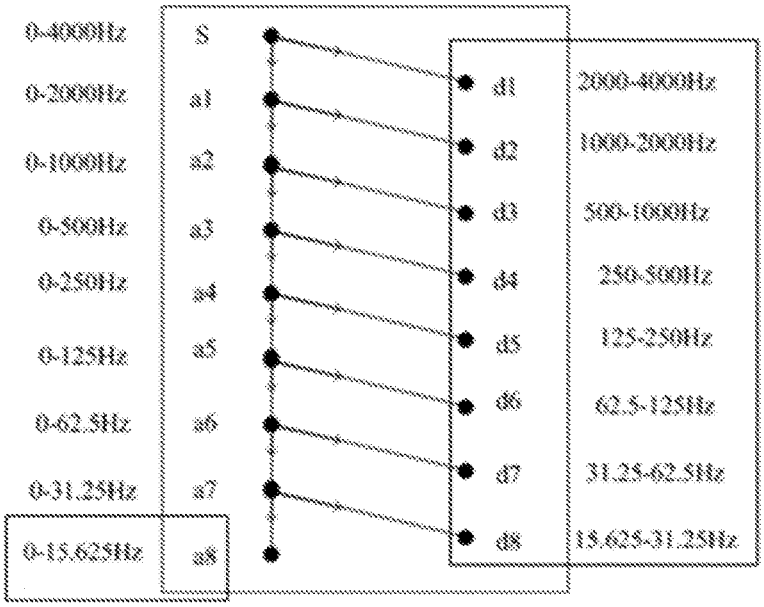
FIG. 3 is a schematic diagram of sub-band signals obtained by means of discrete wavelet transform according to an embodiment of the present disclosure.

Using narrowband voice as an example, for a voice signal whose sampling rate is 8 kHz, several sub-band signals may be obtained by means of discrete wavelet transform. As shown in FIG. 3, an input voice signal may be decomposed. If a decomposition level is 8, a series of sub-band signals $\{a_8, d_8, d_7, d_6, d_5, d_4, d_3, d_2, d_1\}$ may be obtained. According to a wavelet theory, a indicates a sub-band signal in an estimation part of wavelet decomposition, and d indicates a sub-band signal in a detail part of wavelet decomposition. In addition, the voice signal can be entirely reconstructed based on the sub-band signals. In this case, frequency ranges related to different sub-band signals are provided. Particularly, $a_8$ and $d_8$ relate to an articulation power band below 30 Hz, and $d_7$ to $d_1$ relate to a non-articulation power band above 30 Hz.

The essence of this embodiment is determining a quality parameter of communications voice by using energy of the sub-band signals as input. Details are as follows.

401: Obtain a time envelope of a voice signal.

A time envelope of an input signal is obtained. A specific time envelope obtaining manner is the same as that in step 101 in the embodiment shown in FIG. 1.

402: Perform discrete wavelet transform on the time envelope to obtain N+1 sub-band signals.

Discrete wavelet transform is performed on the time envelope of the signal, and a decomposition level N is determined according to a sampling rate. It is ensured that $a_N$ and $d_N$ relate to an articulation power band below 30 Hz. For example, for a voice signal whose sampling rate is 8 kHz, N=8. For a voice signal whose sampling rate is 16 kHz, N=9. By analogy, this embodiment is applicable to another voice signal having a different sampling rate. After discrete wavelet transform is performed on the time envelope of the signal, the N+1 sub-band signals may be obtained.

403: Respectively calculate average energy of the N+1 sub-band signals as feature parameters of corresponding sub-band signals.

Corresponding average energy of the N+1 sub-band signals obtained in a discrete wavelet phase is respectively calculated by using the following formula and is used as feature values of the corresponding sub-band signals, that is, the feature parameters:

$$w_i^{(a)} = \frac{\sum_j s_{i,j}^2}{M_i^{(a)}},\ i = N,\ j = 1, 2, \ldots, M_i^{(a)}, \text{ and}$$

$$w_i^{(d)} = \frac{\sum_j s_{i,j}^2}{M_i^{(d)}},\ i =, 1, 2, \ldots, N,\ i = 1, 2, \ldots, M_i^{(d)}.$$

a and d respectively indicate an estimation part and a detail part of wavelet decomposition. As shown in FIG. 3, a1 to a8 indicate sub-band signals in the estimation part of wavelet decomposition, and d1 to d8 indicate sub-band signals in the detail part of wavelet decomposition. $w_i^{(a)}$ and $w_i^{(d)}$ respectively indicate an average energy value of the sub-band signals in the estimation part and an average energy value of the sub-band signals in the detail part. $S_i$ indicates a specific sub-band signal, i is an index of the sub-band signal, an upper bound of i is N, and N is a decomposition level. For example, as shown in FIG. 3, for a voice signal of 8 kHz, N=8. j is an index of a sub-band signal in the estimation part or the detail part in a corresponding sub-band. An upper bound of j is M, and M is a length of the sub-band signal. $M_i^{(a)}$ and $M_i^{(d)}$ respectively indicate a length of the sub-band signals in an estimation part and a length of the sub-band signals in the detail part.

404: Obtain a first voice quality parameter of the voice signal by using a neural network and according to the average energy of the N+1 sub-band signals.

After the feature parameter of the N+1 sub-band signals is obtained by means of calculation by using the foregoing formula, the voice signal is evaluated by using the neural network or a machine learning method.

Figure 5:
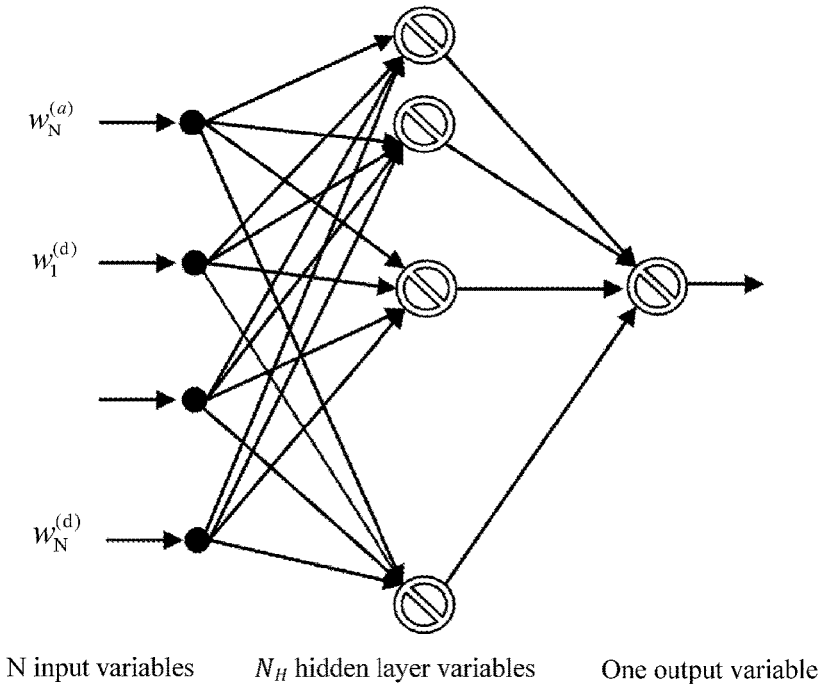
FIG. 5 is a schematic diagram of voice quality evaluation based on a neural network according to an embodiment of the present disclosure.

At present, in terms of voice processing, for example, voice recognition, the neural network or the machine learning method is vastly used. A stable system can be obtained by means of a particular learning process. Therefore, when a new sample is input, an output value can be accurately predicted. FIG. 5 shows a typical structure of a neural network. For $N_I$ input variables ($N_I$=N+1 in this embodiment of the present disclosure), $N_H$ hidden layer variables are obtained by using a mapping function, and then are mapped into one output variable by using a mapping function. $N_H$ is less than N+1.

Specifically, for voice quality evaluation, after N+1 feature parameters are obtained by using the previous steps, the following mapping function is called, so as to obtain a voice quality parameter:

$$y = G_2\left(\sum_{j=1}^{N_H} P_j G_1\left(\sum_{k=1}^{N_I} p_{ij} w_k\right)\right).$$

The mapping function is defined as follows:

$$G_1(x) = \frac{2}{1+\exp(-ax)} - 1, \text{ and}$$

$$G_2(x) = \frac{1}{1+\exp(-ax)}.$$

The three mapping functions in step 404 are in classical forms of a Sigmoid function in the neural network. a is a slope of the mapping function and is a rational number. A value of a cannot be 0. Optionally, the value is equal to 0.3. Value ranges of $G_1(x)$ and $G_2(x)$ may be limited according to an actual scenario. For example, if a result of a prediction model is distortion, the value range is [0, 1.0]. $p_{jk}$ and $p_j$ are respectively used to map an input layer variable to a hidden layer variable and map the hidden layer variable to an output variable. $p_{jk}$ and $p_j$ are rational numbers obtained according to data distribution and training of a training set. It should be noted that, with reference to a common neural network training method, the foregoing parameter value may be obtained by selecting and training a particular quantity of subjective databases.

Preferably, during actual application, a MOS is usually used to represent voice quality. A value of the MOS ranges from 1 score to 5 scores. Therefore, y obtained in the foregoing formula needs to be mapped in the following manner to obtain a MOS:

$$MOS=-4\cdot y+5.$$

In the embodiments of the present disclosure, another method for extracting more articulation feature parameters is provided by using this embodiment of the present disclosure. Wavelet discrete transform is performed on the voice signal to obtain the N+1 sub-band signals; the average energy of the N+1 sub-band signals is calculated, and the average energy of the N+1 sub-band signals is used as input variables of a neural network model, so as to obtain an output variable of the neural network; and then, a MOS representing quality of the voice signal is obtained by means of mapping, so as to obtain the first voice quality parameter. Therefore, voice quality evaluation may be performed by extracting more feature parameters and by means of low-complexity computation.

Optionally, voice quality evaluation is usually performed in real time. Each time a voice signal in a time segment is received, processing of a voice quality evaluation procedure is performed. A result of voice quality evaluation on a voice signal in a current time segment may be considered as a result of short-time voice quality evaluation. To be more objective, the result of voice quality evaluation on the voice signal is combined with a result of voice quality evaluation on at least one historical voice signal, to obtain a result of comprehensive voice quality evaluation.

For example, to-be-evaluated voice data usually lasts 5 seconds or even longer. For convenience of processing, the voice data is usually decomposed into several frames. Lengths of the frames are consistent (for example, 64 milliseconds). Each frame may be used as a to-be-evaluated voice signal, and the method in this embodiment of the present disclosure is called to calculate a frame-level voice quality parameter. Then, voice quality parameters of the frames are combined (preferably, an average value of the frame-level voice quality parameters is calculated), to obtain a quality parameter of the entire voice data.

The voice quality evaluation method is described above, and a voice quality evaluation apparatus in the embodiments of the present disclosure is described below from the perspective of function module implementation.

The voice quality evaluation apparatus may be embedded into a mobile phone to evaluate voice quality during a call, or may be located in a network and serves as a network node, or may be embedded into another network device in a network, so as to synchronously perform quality prediction. A specific application manner is not limited herein.

Figure 6:
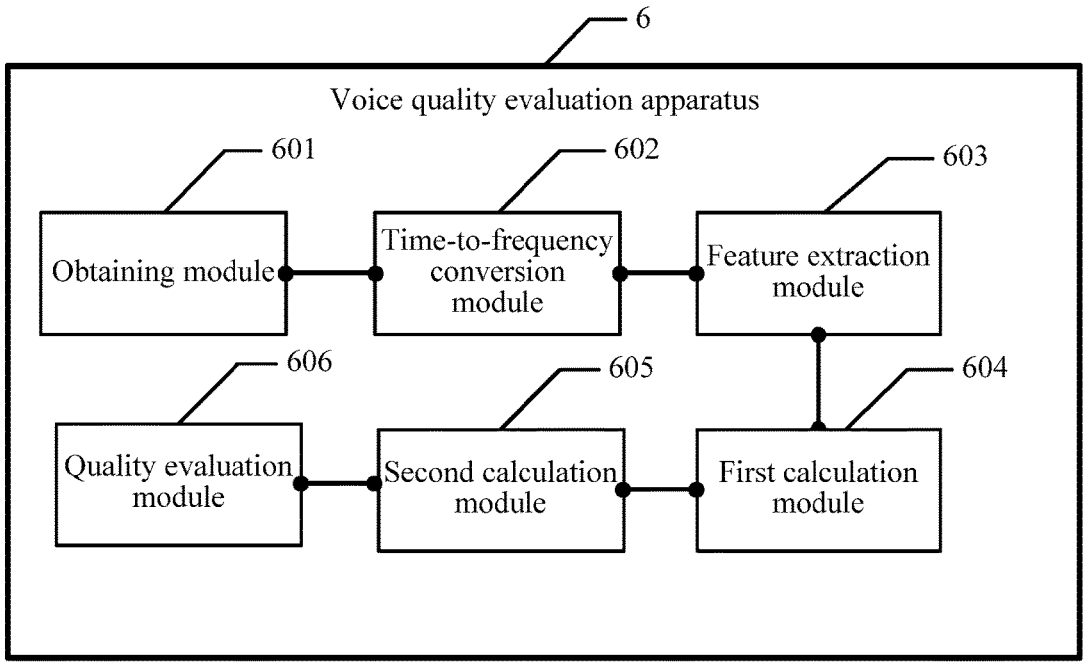
FIG. 6 is a schematic diagram of function modules of a voice quality evaluation apparatus according to an embodiment of the present disclosure.

With reference to FIG. 6, an embodiment of the present disclosure provides a voice quality evaluation apparatus 6, including an obtaining module 601, configured to obtain a time envelope of a voice signal, a time-to-frequency conversion module 602, configured to perform time-to-frequency conversion on the time envelope to obtain an envelope spectrum, a feature extraction module 603, configured to perform feature extraction on the envelope spectrum to obtain a feature parameter, a first calculation module 604, configured to calculate a first voice quality parameter of the voice signal according to the feature parameter, a second calculation module 605, configured to calculate a second voice quality parameter of the voice signal by using a network parameter evaluation model, and a quality evaluation module 606, configured to perform an analysis according to the first voice quality parameter and the second voice quality parameter to obtain a quality evaluation parameter of the voice signal.

In this embodiment of the present disclosure, for an interaction process between the function modules of the voice quality evaluation apparatus 6, refer to the interaction process in the embodiment shown in FIG. 1, and details are not described herein again.

The voice quality evaluation apparatus 6 in this embodiment of the present disclosure does not simulate auditory perception based on a high-complexity cochlea filter. The obtaining module 601 directly obtains the time envelope of the input voice signal; the time-to-frequency conversion module 602 performs time-to-frequency conversion on the time envelope to obtain the envelope spectrum; the feature extraction module 603 performs feature extraction on the envelope spectrum to obtain an articulation feature parameter; later, the first calculation module 604 obtains, according to the articulation feature parameter, the first voice quality parameter of the voice signal that is input in the band; the second calculation module 605 obtains the second voice quality parameter by means of calculation according to the network parameter evaluation model; the quality evaluation module 606 performs a comprehensive analysis according to the first voice quality parameter and the second voice quality parameter to obtain the quality evaluation parameter of the voice signal that is input in the band. Therefore, in this embodiment of the present disclosure, on the basis of covering main impact factors affecting voice quality in voice communications, computational complexity can be reduced, and occupied resources can be reduced.

In some specific implementations, the obtaining module 601 is specifically configured to: perform Hilbert transform on the voice signal to obtain a Hilbert transform signal of the voice signal, and obtain the time envelope of the voice signal according to the voice signal and the Hilbert transform signal of the voice signal.

In some specific implementations, the time-to-frequency conversion module 602 is specifically configured to apply a Hamming window to the time envelope to perform discrete Fourier transform, to obtain the envelope spectrum.

In some specific implementations, the feature extraction module 603 is specifically configured to determine an articulation power frequency band and a non-articulation power frequency band in the envelope spectrum, where the feature parameter is a ratio of a power in the articulation power frequency band to a power in the non-articulation power frequency band.

The first calculation module 604 is specifically configured to calculate the first voice quality parameter of the voice signal by using the following function:

$$y=ax^b.$$

x is the ratio of the power in the articulation power frequency band to the power in the non-articulation power frequency band, and a and b are model parameters obtained by means of sample experimental testing. A value of a cannot be 0. When a MOS is used to represent a voice quality parameter, a value of y ranges from 1 to 5. A group of available model parameters includes a=18, and b=0.72.

The first calculation module 604 is specifically configured to calculate the first voice quality parameter of the voice signal by using the following function:

$$y=a\ \ln(x)+b.$$

x is the ratio of the power in the articulation power frequency band to the power in the non-articulation power frequency band, and a and b are model parameters obtained by means of sample experimental testing. A value of a cannot be 0. When a MOS is used to represent a voice quality parameter, a value of y ranges from 1 to 5. A group of available model parameters includes a=4.9828, and b=15.098.

In some specific implementations, the articulation power frequency band is a frequency band whose frequency bin is 2 Hz to 30 Hz in the envelope spectrum, and the non-articulation power frequency band is a frequency band whose frequency bin is greater than 30 Hz in the envelope spectrum. In this way, in this embodiment of the present disclosure, an articulation power band and a non-articulation power band are defined according to the principle of a human articulation system. This complies with a human articulation psychological auditory theory.

Figure 2:
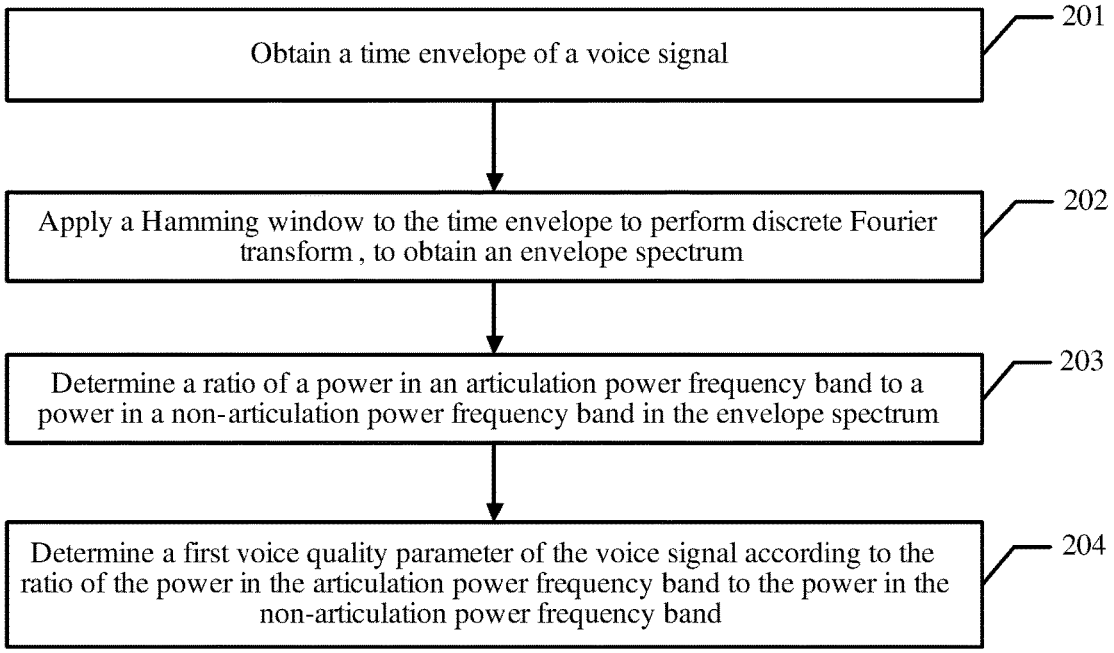
FIG. 2 is another flowchart of a voice quality evaluation method according to an embodiment of the present disclosure.

For an interaction process between the function modules in the foregoing specific implementations, refer to the interaction process in the embodiment shown in FIG. 2, and details are not described herein again.

In some specific implementations, the time-to-frequency conversion module 602 is specifically configured to perform discrete wavelet transform on the time envelope to obtain N+1 sub-band signals, where the N+1 sub-band signals are the envelope spectrum. The feature extraction module 603 is specifically configured to respectively calculate average energy corresponding to the N+1 sub-band signals to obtain N+1 average energy values, where the N+1 average energy values are the feature parameter, and N is a positive integer.

In some specific implementations, the first calculation module 604 is specifically configured to: use the N+1 average energy values as an input layer variable of a neural network, obtain $N_H$ hidden layer variables by using a first mapping function, map the $N_H$ hidden layer variables by using a second mapping function to obtain an output variable, and obtain the first voice quality parameter of the voice signal according to the output variable, where $N_H$ is less than N+1.

Figure 4:
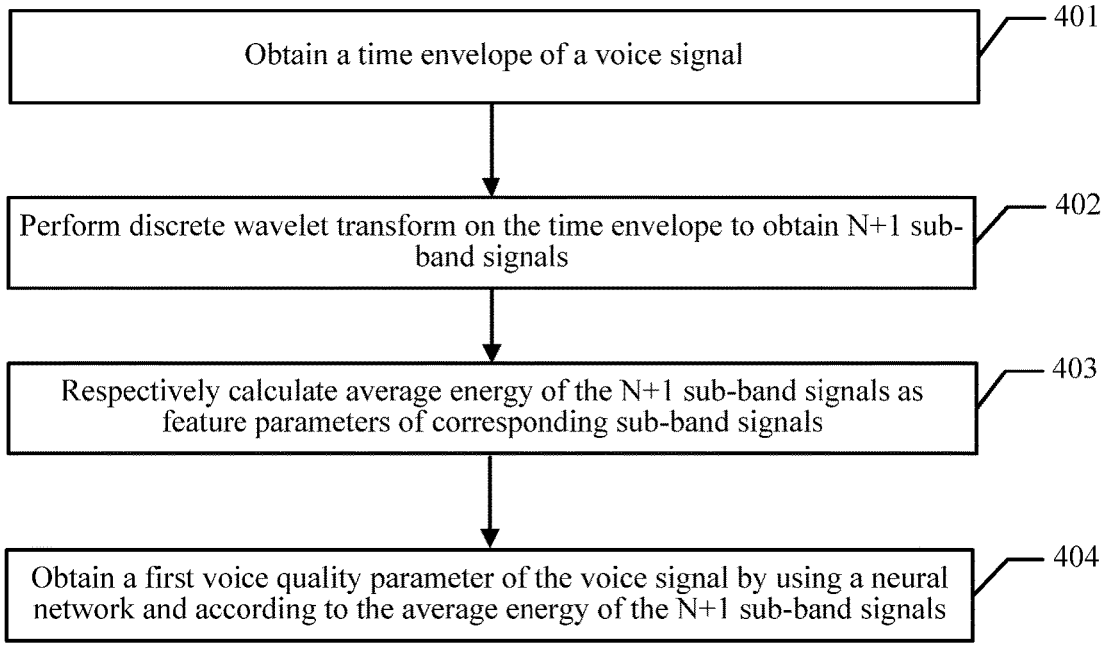
FIG. 4 is another flowchart of a voice quality evaluation method according to an embodiment of the present disclosure.

For an interaction process between the function modules in the foregoing specific implementations, refer to the interaction process in the embodiment shown in FIG. 4, and details are not described herein again.

In some specific implementations, the network parameter evaluation model includes at least one of a bit rate evaluation model or a packet loss rate evaluation model. The second calculation module 605 is specifically configured to: calculate, by using the bit rate evaluation model, a voice quality parameter that is of the voice signal and that is measured by bit rate; and/or calculate, by using the packet loss rate evaluation model, a voice quality parameter that is of the voice signal and that is measured by packet loss rate.

In some specific implementations, the second calculation module 605 is specifically configured to: calculate, by using the following formula, the voice quality parameter that is of the voice signal and that is measured by bit rate:

$$Q_1 = c - \frac{c}{1+\left(\frac{B}{d}\right)^e}.$$

$Q_1$ is the voice quality parameter measured by bit rate and may be represented by a MOS. A value of the MOS ranges from 1 score to 5 scores. B is an encoding bit rate of the voice signal, and c, d, and e are preset model parameters. Such parameters may be obtained by means of sample training of a voice subjective database. c, d, and e are all rational numbers, and values of c and d are not 0.

In some specific implementations, the second calculation module 605 is specifically configured to: calculate, by using the following formula, the voice quality parameter that is of the voice signal and that is measured by packet loss rate:

$$Q_2=fe^{-g\cdot P}.$$

$Q_2$ is the voice quality parameter measured by packet loss rate and may be represented by a MOS. A value range of the MOS is 1 to 5 scores. P is an encoding bit rate of the voice signal, and e, f, and g are preset model parameters. Such parameters may be obtained by means of sample training of a voice subjective database. e, f, and g are all rational numbers, and a value of f is not 0.

In some specific implementations, the quality evaluation module 606 is specifically configured to: add the first voice quality parameter to the second voice quality parameter to obtain the quality evaluation parameter of the voice signal.

In some specific implementations, the quality evaluation module 606 is further configured to calculate an average value of voice quality of the voice signal and voice quality of at least one previous voice signal, to obtain comprehensive voice quality.

A voice quality evaluation device 7 in the embodiments of the present disclosure is described below from the perspective of a hardware structure.

Figure 7:
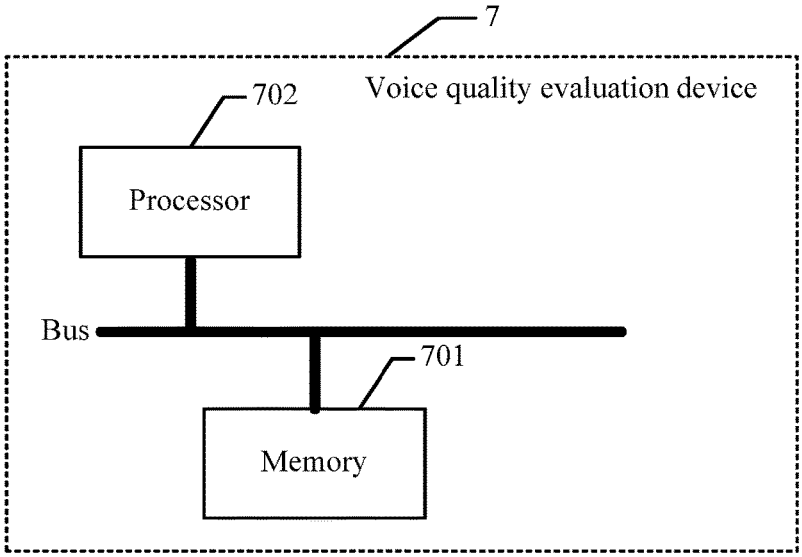
FIG. 7 is a schematic diagram of a hardware structure of a voice quality evaluation device according to an embodiment of the present disclosure.

FIG. 7 is a schematic diagram of a voice quality evaluation device according to an embodiment of the present disclosure. During actual application, the device may be a mobile device having a voice quality evaluation function, or may be a device having a voice quality evaluation function in a network.

The voice quality evaluation device 7 includes at least a memory 701 and a processor 702.

The memory 701 may include a read-only memory and a random access memory, and provide an instruction and data to the processor 702. A part of the memory 701 may further include a high-speed random access memory (RAM), or may further include a non-volatile memory.

The memory 701 stores the following elements: executable modules, or data structures, or a subset thereof, or an extended set thereof; operation instructions, including various operation instructions, and used to implement various operations; and an operating system, including various system programs, and used to implement various fundamental services and process hardware-based tasks.

The processor 702 is configured to execute an application program, so as to perform all or some steps of the voice quality evaluation method in the embodiment shown in FIG. 1, FIG. 2, or FIG. 4.

In addition, the present disclosure further provides a computer storage medium. The medium stores a program. The program performs some or all steps of the voice quality evaluation method in the embodiment shown in FIG. 1, FIG. 2, or FIG. 4.

It should be noted that the terms "include", "contain" and any other variants in the specification of the present disclosure mean to cover the non-exclusive inclusion, for example, a process, method, system, product, or device that includes a list of steps or units is not necessarily limited to those steps or units, but may include other steps or units not expressly listed or inherent to such a process, method, system, product, or device.

It may be clearly understood by persons skilled in the art that, for the purpose of convenient and brief description, for a detailed working process of the foregoing system, apparatus, and unit, refer to a corresponding process in the foregoing method embodiment, and details are not described herein again.

In the several embodiments provided in this application, it should be understood that the disclosed system, apparatus, and method may be implemented in other manners. For example, the described apparatus embodiment is merely an example. For example, the unit division is merely logical function division and may be other division in actual implementation. For example, a plurality of units or components may be combined or integrated into another system, or some features may be ignored or not performed. In addition, the displayed or discussed mutual couplings or direct couplings or communication connections may be implemented by using some interfaces. The indirect couplings or communication connections between the apparatuses or units may be implemented in electronic, mechanical, or other forms.

The units described as separate parts may or may not be physically separate, and parts displayed as units may or may not be physical units, may be located in one position, or may be distributed on a plurality of network units. Some or all of the units may be selected according to actual requirements to achieve the objectives of the solutions of the embodiments.

In addition, functional units in the embodiments of the present disclosure may be integrated into one processing unit, or each of the units may exist alone physically, or two or more units are integrated into one unit. The integrated unit may be implemented in a form of hardware, or may be implemented in a form of a software functional unit.

When the integrated unit is implemented in the form of a software functional unit and sold or used as an independent product, the integrated unit may be stored in a computer-readable storage medium. Based on such an understanding, the technical solutions of the present disclosure essentially, or the part contributing to the prior art, or all or some of the technical solutions may be implemented in the form of a software product. The computer software product is stored in a storage medium and includes several instructions for instructing a computer device (which may be a personal computer, a server, or a network device) to perform all or some of the steps of the methods described in the embodiments of the present disclosure. The foregoing storage medium includes any medium that can store program code, such as a universal serial bus (USB) flash drive, a removable hard disk, a read-only memory (ROM), a RAM, a magnetic disk, or an optical disc.

The foregoing embodiments are merely intended for describing the technical solutions of the present disclosure, but not for limiting the present disclosure. Although the present disclosure is described in detail with reference to the foregoing embodiments, persons of ordinary skill in the art should understand that they may still make modifications to the technical solutions described in the foregoing embodiments or make equivalent replacements to some technical features thereof, without departing from the spirit and scope of the technical solutions of the embodiments of the present disclosure.

What is claimed is:

1. A voice quality evaluation method, comprising:

obtaining a time envelope of a voice signal;

performing time-to-frequency conversion on the time envelope to obtain an envelope spectrum;

performing feature extraction on the envelope spectrum to obtain a feature parameter;

calculating a first voice quality parameter of the voice signal according to the feature parameter;

calculating a second voice quality parameter of the voice signal using a network parameter evaluation model, wherein the network parameter evaluation model comprises a bit rate evaluation model or a packet loss rate evaluation model, and wherein calculating the second voice quality parameter of the voice signal using the network parameter evaluation model comprises:

calculating, using the bit rate evaluation model, a voice quality parameter $Q_1$ using the following formula:

$$Q_1 = c - \frac{c}{1 + \left(\frac{B}{d}\right)^e},$$

wherein B is an encoding bit rate of the voice signal, and wherein c, d, and e are first preset model parameters and are rational numbers, or calculating, using the packet loss rate evaluation model, a voice quality parameter $Q_2$ using the following formula: $Q_2 = fe^{-g \cdot P}$, wherein P is the encoding bit rate of the voice signal, and wherein e, f, and g are second preset model parameters and are rational numbers; and performing an analysis according to the first voice quality parameter and the second voice quality parameter to obtain a quality evaluation parameter of the voice signal.

2. The method of claim 1, wherein performing the feature extraction on the envelope spectrum to obtain the feature parameter comprises determining an articulation power frequency band and a non-articulation power frequency band in the envelope spectrum, wherein the feature parameter is a ratio of a power in the articulation power frequency band to a power in the non-articulation power frequency band, wherein the articulation power frequency band is a frequency band whose frequency bin is 2 hertz (Hz) to 30 Hz in the envelope spectrum, and wherein the non-articulation power frequency band is a frequency band whose frequency bin is greater than 30 Hz in the envelope spectrum.

3. The method of claim 2, wherein calculating the first voice quality parameter of the voice signal according to the feature parameter comprises calculating the first voice quality parameter of the voice signal using the following function:

$$y=ax^b,$$

wherein x is the ratio of the power in the articulation power frequency band to the power in the non-articulation power frequency band, and wherein a and b are third preset model parameters and are rational numbers.

4. The method of claim 2, wherein calculating the first voice quality parameter of the voice signal according to the feature parameter comprises calculating the first voice quality parameter of the voice signal using the following function:

$$y=a\ \ln(x)+b,$$

wherein x is the ratio of the power in the articulation power frequency band to the power in the non-articulation power frequency band, and wherein a and b are third preset model parameters and are rational numbers.

5. The method of claim 1, wherein performing the time-to-frequency conversion on the time envelope to obtain the envelope spectrum comprises performing discrete wavelet transform on the time envelope to obtain N+1 sub-band signals, wherein N is a positive integer, wherein performing the feature extraction on the envelope spectrum to obtain the feature parameter comprises respectively calculating average energy corresponding to the N+1 sub-band signals to obtain N+1 average energy values, and wherein the N+1 average energy values are the feature parameter.

6. The method of claim 5, wherein calculating the first voice quality parameter of the voice signal according to the feature parameter comprises:

using the N+1 average energy values as an input layer variable of a neural network;

obtaining $N_H$ hidden layer variables using a first mapping function;

mapping the $N_H$ hidden layer variables using a second mapping function to obtain an output variable; and obtaining the first voice quality parameter of the voice signal according to the output variable, wherein $N_H$ is less than N+1.

7. The method of claim 1, wherein performing the analysis according to the first voice quality parameter and the second voice quality parameter to obtain the quality evaluation parameter of the voice signal comprises adding the first voice quality parameter to the second voice quality parameter to obtain the quality evaluation parameter of the voice signal.

8. A voice quality evaluation apparatus, comprising:

a memory; and a processor coupled to the memory and configured to:

obtain a time envelope of a voice signal;

perform time-to-frequency conversion on the time envelope to obtain an envelope spectrum;

perform feature extraction on the envelope spectrum to obtain a feature parameter;

calculate a first voice quality parameter of the voice signal according to the feature parameter;

calculate a second voice quality parameter of the voice signal by using a network parameter evaluation model, wherein the network parameter evaluation model comprises a bit rate evaluation model or a packet loss rate evaluation model, and wherein the processor is configured to calculate the second voice quality parameter of the voice signal using the network parameter evaluation model by being configured to:

calculate, using the bit rate evaluation model, a voice quality parameter $Q_1$ using the following formula:

$$Q_1 = c - \frac{c}{1+\left(\frac{B}{d}\right)^e},$$

wherein B is an encoding bit rate of the voice signal, and wherein c, d, and e are first preset model parameters and are rational numbers, or calculate, using the packet loss rate evaluation model, a voice quality parameter $Q_2$ using the following formula: $Q^2=fe^{-g\cdot P}$, wherein P is the encoding bit rate of the voice signal, and wherein e, f, and g are second preset model parameters and are rational numbers; and perform an analysis according to the first voice quality parameter and the second voice quality parameter to obtain a quality evaluation parameter of the voice signal.

9. The apparatus of claim 8, wherein the processor is configured to determine an articulation power frequency band and a non-articulation power frequency band in the envelope spectrum, wherein the feature parameter is a ratio of a power in the articulation power frequency band to a power in the non-articulation power frequency band, wherein the articulation power frequency band is a frequency band whose frequency bin is 2 hertz (Hz) to 30 Hz in the envelope spectrum, and wherein the non-articulation power frequency band is a frequency band whose frequency bin is greater than 30 Hz in the envelope spectrum.

10. The apparatus of claim 9, wherein the processor is configured to calculate the first voice quality parameter of the voice signal using the following function:

$$y=ax^b,$$

wherein x is the ratio of the power in the articulation power frequency band to the power in the non-articulation power frequency band, and wherein a and b are third preset model parameters and are rational numbers.

11. The apparatus of claim 9, wherein the processor is configured to calculate the first voice quality parameter of the voice signal using the following function:

$$y=a\ \ln(x)+b,$$

wherein x is the ratio of the power in the articulation power frequency band to the power in the non-articulation power frequency band, and wherein a and b are third preset model parameters and are rational numbers.

12. The apparatus of claim 8, wherein the processor is configured to:

perform discrete wavelet transform on the time envelope to obtain N+1 sub-band signals, wherein the N+1 sub-band signals are the envelope spectrum, and wherein N is a positive integer; and respectively calculate average energy corresponding to the N+1 sub-band signals to obtain N+1 average energy values, wherein the N+1 average energy values are the feature parameter.

13. The apparatus of claim 12, wherein the processor is configured to:

use the N+1 average energy values as an input layer variable of a neural network;

obtain $N_H$ hidden layer variables by using a first mapping function;

map the $N_H$ hidden layer variables by using a second mapping function to obtain an output variable; and obtain the first voice quality parameter of the voice signal according to the output variable, wherein $N_H$ is less than N+1.

14. The apparatus of claim 8, wherein the processor is configured to add the first voice quality parameter to the second voice quality parameter to obtain the quality evaluation parameter of the voice signal.

15. A voice quality evaluation method, comprising:

obtaining a time envelope of a voice signal;

performing time-to-frequency conversion on the time envelope to obtain an envelope spectrum, wherein performing the time-to-frequency conversion on the time envelope comprises performing discrete wavelet transform on the time envelope to obtain N+1 sub-band signals, wherein the envelope spectrum comprises the N+1 sub-band signals, wherein N is a positive integer;

performing feature extraction on the envelope spectrum to obtain a feature parameter, wherein performing the feature extraction on the envelope spectrum comprises respectively calculating average energy that correspond to the N+1 sub-band signals to obtain N+1 average energy values, wherein the N+1 average energy values are the feature parameter;

calculating a first voice quality parameter of the voice signal according to the feature parameter, comprising:

using the N+1 average energy values as an input layer variable of a neural network;

obtaining $N_H$ hidden layer variables using a first mapping function, wherein $N_H$ is less than N+1;

mapping the $N_H$ hidden layer variables using a second mapping function to obtain an output variable; and obtaining the first voice quality parameter of the voice signal according to the output variable;

calculating a second voice quality parameter of the voice signal using a network parameter evaluation model, wherein the network parameter evaluation model comprises a bit rate evaluation model or a packet loss rate evaluation model, wherein the bit rate evaluation model and the packet loss rate evaluation model use an encoding bit rate of the voice signal; and performing an analysis according to the first voice quality parameter and the second voice quality parameter to obtain a quality evaluation parameter of the voice signal.

16. The method of claim 15, wherein calculating the second voice quality parameter using the network parameter evaluation model comprises calculating, according to the following formula, a voice quality parameter $Q_1$:

$$Q_1 = c - \frac{c}{1 + \left(\frac{B}{d}\right)^e},$$

wherein B is the encoding bit rate of the voice signal, and wherein c, d, and e are preset model parameters and are all rational numbers.

17. The method of claim 16, wherein calculating the second voice quality parameter using the network parameter evaluation model comprises calculating, according to the following formula, a voice quality parameter $Q_2$:

$$Q_2 = fe^{-g \cdot P},$$

wherein P is the encoding bit rate of the voice signal, and wherein e, f, and g are preset model parameters and are rational numbers.

* * * * *